United States Patent [19]

Kim

[11] Patent Number: 4,566,953

[45] Date of Patent: Jan. 28, 1986

[54] PULSE PLATING OF NICKEL-ANTIMONY FILMS

[75] Inventor: Tae Y. Kim, Carmel Township, Hamilton County, Ind.

[73] Assignee: AT&T Technologies, Inc., Berkeley Heights, N.J.

[21] Appl. No.: 685,774

[22] Filed: Dec. 24, 1984

[51] Int. Cl.[4] ..... C25D 3/56; C25D 5/18

[52] U.S. Cl. ..... 204/28; 204/44.5; 204/DIG. 9

[58] Field of Search ..... 204/DIG. 9, 44.5, 28

[56] References Cited

U.S. PATENT DOCUMENTS

| | | | |
|---|---|---|---|
| 2,095,302 | 10/1937 | Woodford et al. | 420/576 X |
| 2,823,176 | 2/1958 | Breining et al. | 204/43.1 X |
| 2,867,550 | 1/1959 | Weber | 420/576 X |
| 3,752,754 | 8/1973 | Olson et al. | 204/228 |
| 4,361,718 | 11/1982 | Marcus et al. | 136/256 |
| 4,496,436 | 1/1985 | Inoue | 204/23 |

FOREIGN PATENT DOCUMENTS

| | | | |
|---|---|---|---|
| 2354256 | 5/1975 | Fed. Rep. of Germany | 200/266 |
| 15768 | 5/1973 | Japan | 420/441 |
| 415329 | 2/1974 | U.S.S.R. | 420/576 |

*Primary Examiner*—G. L. Kaplan

*Attorney, Agent, or Firm*—J. F. Spivak

[57] ABSTRACT

A method of plating a ductile Ni-Sb alloy on a substrate from a solution containing a Ni salt and a mixed alkali metal-antimony salt comprises pulse plating wherein the off-time is much longer than the on-time.

11 Claims, 10 Drawing Figures

D.C.

Pulse

D.C.

10 ms ON 25 ms OFF 10 ms On 50 ms OFF 10 ms On 75 ms OFF 10 ms On 100 ms OFF 10 ms On 150 ms OFF

PULSE PLATING OF NICKEL-ANTIMONY FILMS

TECHNICAL FIELD

This invention relates to nickel-antimony alloy compositions for electrical contacts and particularly, pulse plating methods of making such compositions.

BACKGROUND OF THE INVENTION

Generally, for a material to be suitable for use as an electrical contact, it should be non-fusing with a mating contact material and have a low, ohmic, contact resistance with a relatively small contact pressure. In addition, the material must be capable of maintaining a low resistance after a large number of operations over an extended life period and be corrosion resistant.

Among the contact materials employed in the past are the precious metals such as gold, palladium and platinum and alloys of such metals with each other as well as with metals such as silver and nickel. Due to the high cost of precious metals, a large effort has been employed to find contact materials which are substantially cheaper than the precious metals but which also possess all or many of the properties of the precious metals as mentioned above and for certain applications, are also solderable. In a recently filed copending application, Ser. No. 646,665, now U.S. Pat. No. 4,518,469 there is described nickel-antimony alloys which are suitable for use as a contact material. That patent application also describes a process for electroplating films of such contact materials employing dc plating techniques. While such dc plated films are adequate for many uses, especially where high ductility is not required, in certain other applications such as a coating over a copper wire where the wire may undergo considerable bending, high ductility is required. For such applications the dc electroplating method has been found to be inadequate due to insufficient ductility of the electroplated film.

The present invention describes a pulse plating technique for electroplating nickel-antimony films having high ductility sufficient for use for the plating of wire.

SUMMARY OF THE INVENTION

A method for electroplating a nickel-antimony alloy comprising from 1 to 12 weight percent of antimony and the balance essentially nickel comprises electroplating the alloy from a solution containing a soluble nickel salt and a soluble mixed antimony alkali metal salt of a polybasic organic acid at a pH in the range of from about 1 to 6 wherein a pulse plating current is applied having an off-time of from 125 to 300 milliseconds and an on-time of from 5 to 20 milliseconds.

Nickel-antimony films made by the above method result in thin, uniform, bright metallic films having high ductility and are particularly suitable for use in coating of wire.

DETAILED DESCRIPTION

Figure 1:
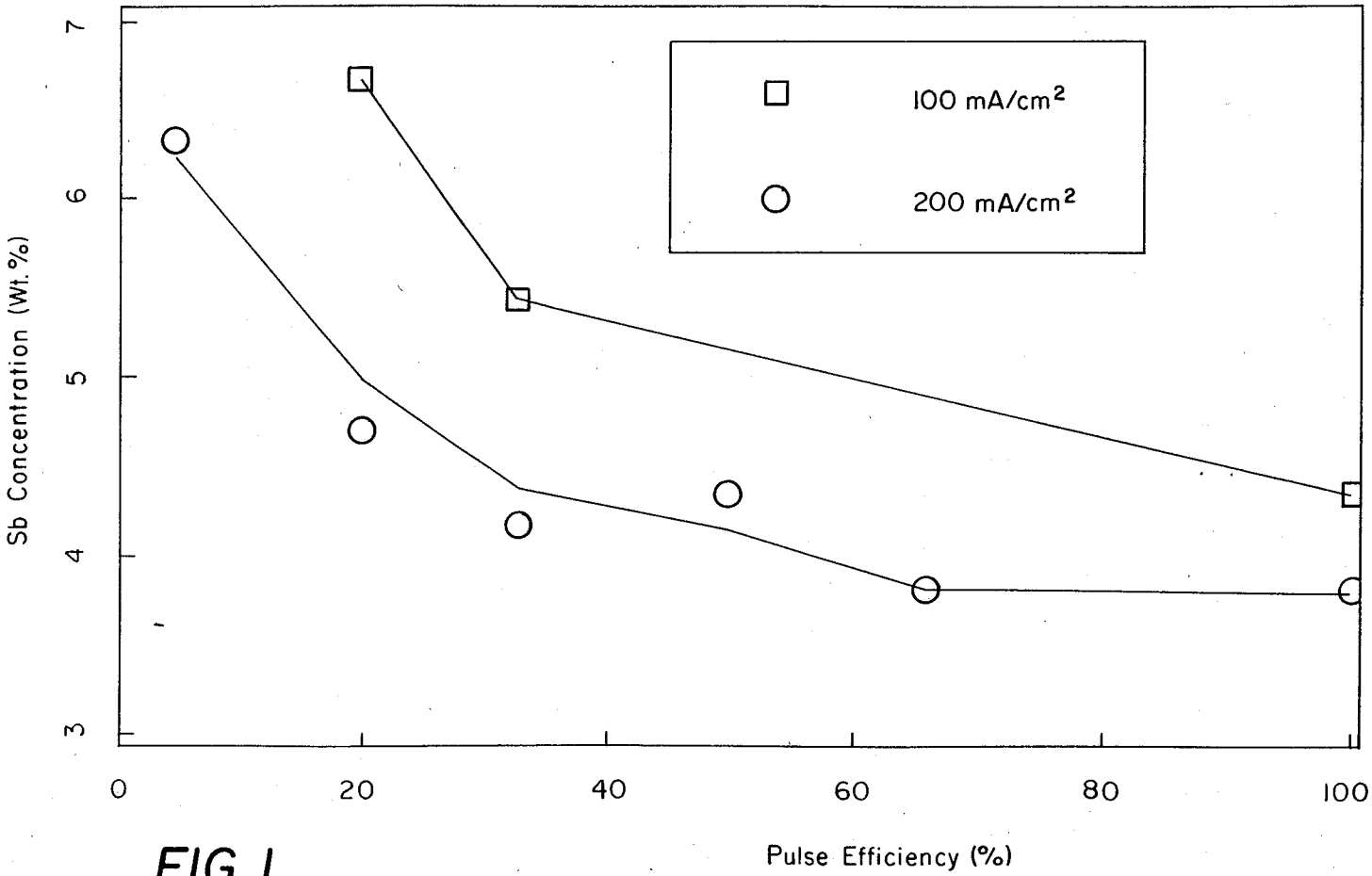
FIG. 1 is a plot of the antimony concentration in weight percent of antimony in the electroplated film versus pulse efficiency in percent showing the overall effect of pulse plating on the antimony concentration at 2 current densities.

Nickel antimonide and nickel-antimony alloys present a low cost substitute for gold as an electrical contact material. Coatings or films of these alloys can be deposited by low cost electrolytic plating techniques. An electrolytic plating bath useful for the deposition of uniform bright nickel-antimony alloy films and the plating conditions for using said baths are taught herein.

I have found that utilizing the plating procedures as described herein, nickel-antimony alloys bearing an antimony content of from 1–12 percent can be prepared. It has further been found that these alloys are substantially more ductile then similar alloys prepared by dc electroplating techniques. These more ductile alloy films are particularly suitable for use in situations where the alloy must undergo bending such as in coated wires.

Generally, the desired nickel-antimony alloy films can be deposited by electroplating under pulse conditions including an on-time of from 5 to 20 milliseconds and an off-time of from 150 to 300 milliseconds. I have found unexpectedly that the relatively long off time and short on time is critical to obtaining high ductility films. The plating bath from which the film is deposited is an acidic aqueous solution containing a soluble nickel salt and an alkali metal-antimony salt of a polybasic organic acid. For example, the nickel salt can be nickel sulfate, nickel sulfamate or a combination thereof. Electroplating baths containing nickel sulfamate have been found to be preferred for obtaining high ductile material under pulse plating conditions. Examples of suitable soluble antimony compounds for use in the electroplating bath include alkali metal antimony dibasic acid salts such as potassium antimony oxalate or sodium antimony succinate, alkali metal antimony hydroxy di or tribasic acid salts such as potassium antimony maleate or sodium antimony citrate or potassium antimony tartrate, the latter salt being preferred. In operation of the bath, the bath should be agitated. However, in the production of coated wire, the wire is generally passed through the bath between moving reels which in itself produces sufficient agitation such that only additional mild agitation is preferred.

The particular films deposited from the electroplating baths will depend not only upon the particular bath constituents employed, but the concentration of antimony in the bath, the bath temperature and pH, the particular current density used for plating and the degree of agitation.

A preferred bath comprises 20 ounces per gallon nickel sulfamate, 15 ounces per gallon nickel sulfate, 0.6 grams per liter potassium antimony tartrate and 30 grams per liter of boric acid. A typical operating temperature of the bath is about 55° C. at a pH of 3.5 and a current density of about 200 milliamps per square centimeter. A preferred pulse plating rate is based upon a 10 millisecond on-time and a 200 millisecond off-time. Utilizing such a plating bath and plating parameters, copper wire can be plated with a nickel-antimony alloy at a rate of about 2 feet per minute with a bath length of 55 inches so as to form a nickel-antimony deposit of about 40 microinches.

Further details of other suitable plating bath compositions can be found with reference to the aforementioned U.S. patent application Ser. No. 646,665 which is incorporated herein by reference.

Referring to FIG. 1 there is shown a graphical representation of the pulse efficiency upon the weight percent antimony found in the plated film at two current densities. The pulse efficiency is the on-time divided by the sum of the on-time and off-time multiplied by 100. The results were obtained (except for dc conditions of 100% on-time) utilizing a fixed off-time of 200 milliseconds and increasing the on-time from 10 to 400 milliseconds. As can be seen from the curves, a higher percent antimony can be achieved at the lower of the two current densities shown. Further, the percent antimony in the deposit rises sharply at pulse efficiencies of about 33% and less. On this graph, this represents on-times of less than about 100 milliseconds with shorter on-times being preferred since it is preferred to increase the percent antimony in the film.

Figure 2:
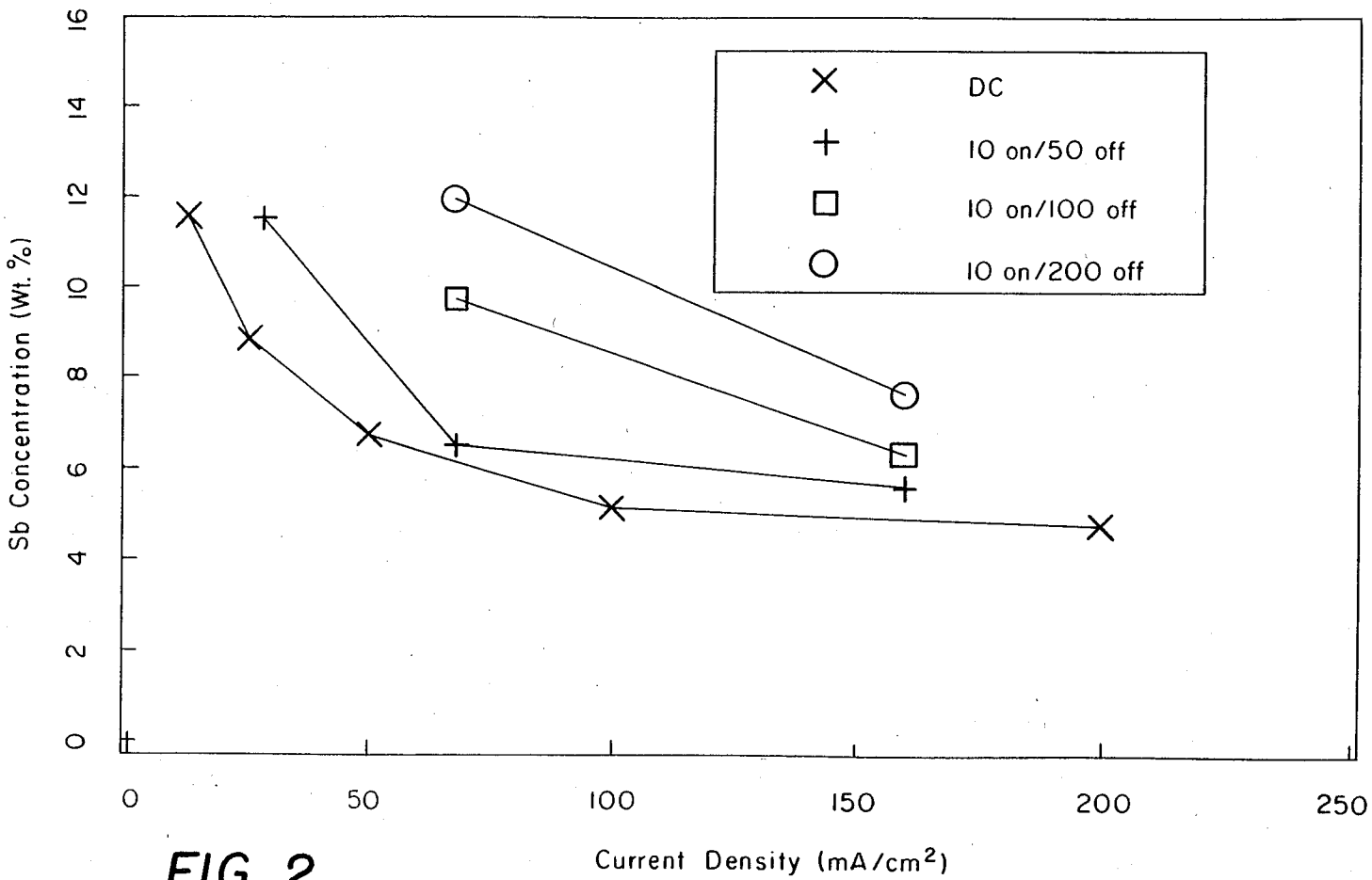
FIG. 2 is a plot showing the antimony concentration in weight percent of antimony in the electroplated film versus current density for films prepared under various electroplating conditions.

Referring to FIG. 2 there is presented a series of curves showing the percent antimony attained in nickel-antimony films plated on wire as a function of current density for different pulse parameters and for DC plating. As can readily be seen, the DC plating resulted in the lowest antimony concentration at all current densities as compared with pulse plating. Further, the longer the off-time as compared with a constant 10 millisecond on-time, the greater the resulting antimony concentration at any given current density. One can also see that current densities of less than 100 are generally preferable. However, this must be tempered with plating speed in commercial operations. The same is true for the relative on-time vs. off-time. With reference to the series of photomicrographs which illustrate the degree of cracking or blistering upon bending were plated with Ni-Sb alloy at various pulse conditions, one can see again that the ratio of off-time to on-time should be high, e.g., at least about 15:1 before films having adequate ductility are attained. While this ratio is true for a 10 millisecond on-time pulse, the ratio may be half that when the on-time is 20 milliseconds.

Figure 3A:
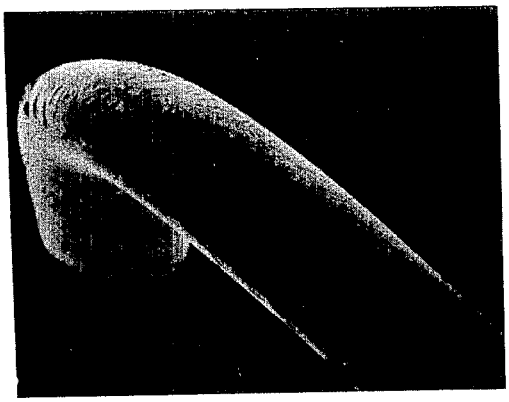
FIGS. 3*a* and 3*b* are photomicrographs of (a) a wire plated with nickel-antimony alloy under dc conditions from a nickel sulfate bath at 55° C. and (b) a wire plated with nickel-antimony alloy from a nickel sulfate-nickel sulfamate bath at 55° C. under pulse plating conditions.
Figure 3B:
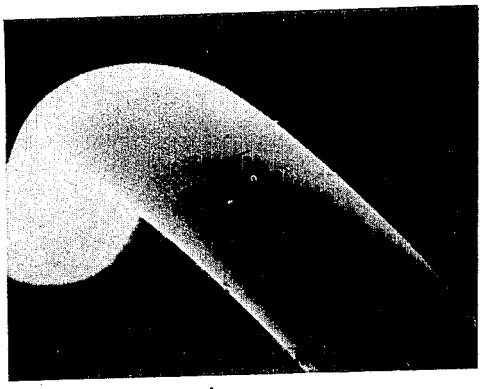
Figure 4:
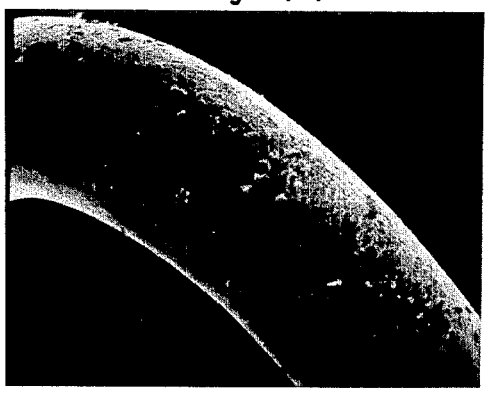
FIGS. 4*a*–4*f* are a series of photomicrographs of plated wire showing the pulse effect upon ductility of a nickel-antimony deposit deposited from the same solution at different pulse parameters of on-times and off-times.
Figure 4:
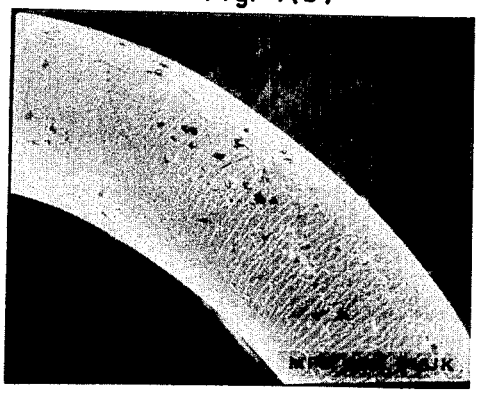
Figure 4:
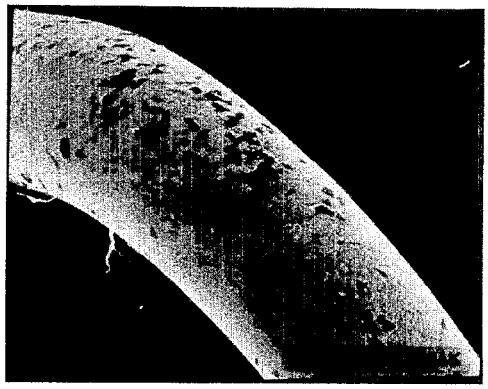
Figure 4:
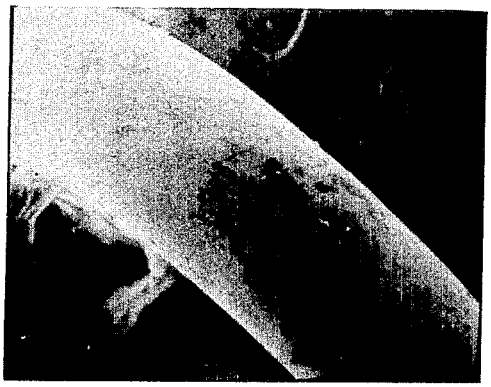
Figure 4:
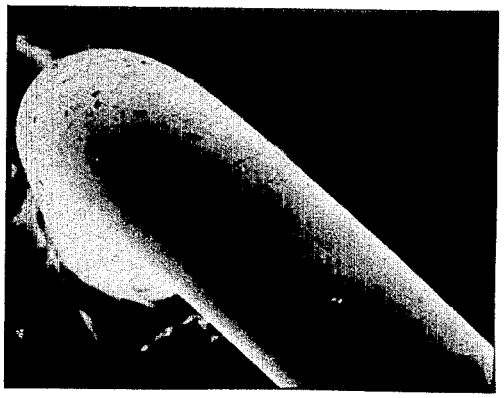
Figure 4:
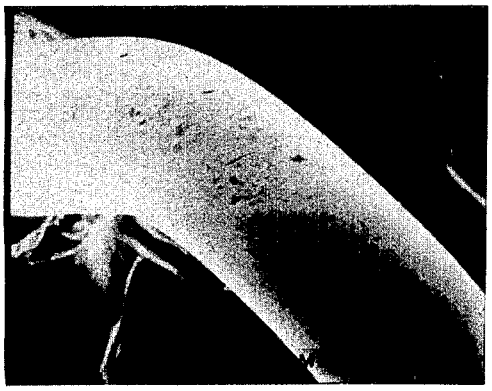

As can be seen from FIGS. 3*a* and 3*b*, pulse plating results in substantially less cracking upon bending than DC. Further, from FIG. 4*a–f* the importance of the long off-time and short on-time of the pulse is readily observable. Only plating with off-time of 150 milliseconds show essentially no or limited cracking.

What is claimed is:

1. A method for electroplating a nickel-antimony alloy onto a metallic substrate comprising from 1 to 12 weight percent antimony comprises electroplating the alloy from a solution containing a soluble nickel salt and a soluble mixed antimony-alkali metal salt at a pH of from about 1 to 6 by means of a pulsed current having an on-time of from 5 to 20 milliseconds and an off-time of from 150 to 300 milliseconds.

2. The method recited in claim 1, wherein the ratio of off-time to on-time is at least 10:1.

3. The method recited in claim 1, wherein the substrate is a wire which is drawn through the plating solution.

4. The method recited in claim 3, wherein the wire is passed through the solution at a speed so as to cause agitation of the solution.

5. The method recited in claim 1, wherein the current density is less than 200 ma/cm$^2$.

6. The method recited in claim 1, wherein the current density is 200 ma/cm$^2$ or less.

7. The method recited in claim 1, wherein the pulse efficiency is 33 ½% or less.

8. The method recited in claim 1, wherein the nickel salt is selected from nickel sulfamate and a mixture of nickel sulfate and nickel sulfamate.

9. The method recited in claim 8, wherein the antimony containing salt is an alkali metal-antimony salt of a polybasic organic acid.

10. The method recited in claim 9, wherein the salt is an alkali metal antimony tartrate.

11. The method recited in claim 9, wherein the solution is buffered with boric acid.

* * * * *